US011501749B1

(12) United States Patent
Moyal et al.

(10) Patent No.: US 11,501,749 B1
(45) Date of Patent: Nov. 15, 2022

(54) SELECTIVE ALLOWANCE OF SOUND IN NOISE CANCELLATION HEADSET IN AN INDUSTRIAL WORK ENVIRONMENT

(71) Applicant: INTERNATIONAL BUSINESS MACHINES CORPORATION, Armonk, NY (US)

(72) Inventors: Shailendra Moyal, Pune (IN); Sarbajit K. Rakshit, Kolkata (IN); Venkata Vara Prasad Karri, Visakhapatnam (IN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 17/444,694

(22) Filed: Aug. 9, 2021

(51) Int. Cl.
*G10K 11/178* (2006.01)
*H04R 25/00* (2006.01)
*H04R 1/10* (2006.01)

(52) U.S. Cl.
CPC .. *G10K 11/17885* (2018.01); *G10K 11/17827* (2018.01); *H04R 1/1083* (2013.01); *H04R 25/505* (2013.01); *G10K 2210/1081* (2013.01)

(58) Field of Classification Search
None
See application file for complete search history.

(56) References Cited

U.S. PATENT DOCUMENTS

2014/0044269 A1 2/2014 Anderson
2015/0294662 A1 10/2015 Ibrahim
2016/0014497 A1 1/2016 Chizi
2018/0365982 A1 12/2018 Kumar
(Continued)

FOREIGN PATENT DOCUMENTS

EP 1377961 A2 1/2004
EP 2465111 A2 6/2012
(Continued)

OTHER PUBLICATIONS

Author Unknown, "Monitor noise to reduce the risk of hearing loss," Maintenance & Engineering, Jun. 16, 2021, https://www.maintenanceandengineering.com/2020/06/16/monitor-noise-to-reduce-the-risk-of-hearing-loss/, 3 pages.
(Continued)

*Primary Examiner* — Kenny H Truong
(74) *Attorney, Agent, or Firm* — Anthony M. Pallone

(57) ABSTRACT

According to one embodiment, a method, computer system, and computer program product for allowing selective sounds within a noise cancellation headset. The embodiment may include receiving a sound from a noise-filled environment. A source of the sound is a machine within the noise-filled environment. The embodiment may include determining that the sound is indicative of a problem within the noise-filled environment. The embodiment may include identifying a severity of the problem. The embodiment may include identifying a user within a boundary range of the problem. The boundary range is based, in part, on the severity of the problem. The user is wearing a noise cancellation headset which is actively cancelling sounds of the noise-filled environment. The embodiment may include allowing the sound to be heard within the noise cancellation headsets of the identified user.

17 Claims, 6 Drawing Sheets

(56) References Cited

U.S. PATENT DOCUMENTS

| | | | | |
|---|---|---|---|---|
| 2020/0135163 | A1* | 4/2020 | Lovitt | G10K 11/17827 |
| 2020/0160875 | A1 | 5/2020 | Giri | |

FOREIGN PATENT DOCUMENTS

| | | | |
|---|---|---|---|
| WO | 02082422 | A2 | 10/2002 |
| WO | 2011020992 | A2 | 2/2011 |

OTHER PUBLICATIONS

Author Unknown, "Noise and The Importance of Hearing Protection in The Workplace," Optimum Safety Management, Accessed: Jun. 22, 2021, https://www.optimumsafetymanagement.com/blog/noise-importance-hearing-protection-workplace/, 4 pages.

Disclosed Anonymously, Method and System for Allowing One or More Sounds to Pass Through Noise-Cancelling Audio Reproduction Device, IP.com, IP.com No. IPCOM000216395D, IP.com Publication Date: Apr. 3, 2012, 6 pages.

Mell et al., "The NIST Definition of Cloud Computing", National Institute of Standards and Technology, Special Publication 800-145, Sep. 2011, 7 pages.

Osha, "Occupational Noise Exposure," MSC Direct, Accessed: Jun. 22, 2021, https://www.mscdirect.com/betterMRO/safety/occupational-noise-exposure, 2 pages.

Xu et al., "Selective active noise cancellation based on directional reference signals," The Journal of the Acoustical Society of America 146, 2794 (2019); https://doi.org/10.1121/1.5136678, Abstract Only, 4 pages.

* cited by examiner

SELECTIVE ALLOWANCE OF SOUND IN NOISE CANCELLATION HEADSET IN AN INDUSTRIAL WORK ENVIRONMENT

BACKGROUND

The present invention relates generally to the field of computing, and more particularly to active noise control.

Active noise control (ANC), also known as noise cancellation (NC), or active noise reduction (ANR), is a method for reducing unwanted sound by the addition of a second sound specifically designed to cancel the unwanted sound. Sound is a pressure wave which consists of alternating periods of compression and rarefaction. A noise-cancellation speaker emits a sound wave with the same amplitude but with inverted phase relative to an original sound (e.g., an unwanted sound). In a process called interference, the waves combine to form a new wave and effectively cancel each other out. This effect is called destructive interference. Modern ANC is generally achieved using analog circuits or digital signal processing. Adaptive algorithms are designed to analyze the waveform of the background noise, then generate a signal that will either phase shift or invert the polarity of the original signal. This inverted signal is amplified, and a transducer creates a sound wave directly proportional to the amplitude of the original waveform, creating destructive interference and effectively reducing the volume of the perceivable noise. Noise-cancelling headphones are headphones that reduce unwanted or unsafe sound levels using ANC. For example, in the context of an industrial work environment, employee headsets may employ ANC to mitigate the risk of noise induced hearing loss (NIHL).

SUMMARY

According to one embodiment, a method, computer system, and computer program product for allowing selective sounds within a noise cancellation headset. The embodiment may include receiving a sound from a noise-filled environment. A source of the sound is a machine within the noise-filled environment. The embodiment may include determining that the sound is indicative of a problem within the noise-filled environment. The embodiment may include identifying a severity of the problem. The embodiment may include identifying a user within a boundary range of the problem. The boundary range is based, in part, on the severity of the problem. The user is wearing a noise cancellation headset which is actively cancelling sounds of the noise-filled environment. The embodiment may include allowing the sound to be heard within the noise cancellation headsets of the identified user.

BRIEF DESCRIPTION OF THE SEVERAL VIEWS OF THE DRAWINGS

These and other objects, features and advantages of the present invention will become apparent from the following detailed description of illustrative embodiments thereof, which is to be read in connection with the accompanying drawings. The various features of the drawings are not to scale as the illustrations are for clarity in facilitating one skilled in the art in understanding the invention in conjunction with the detailed description. In the drawings.

DETAILED DESCRIPTION

Figure 1:
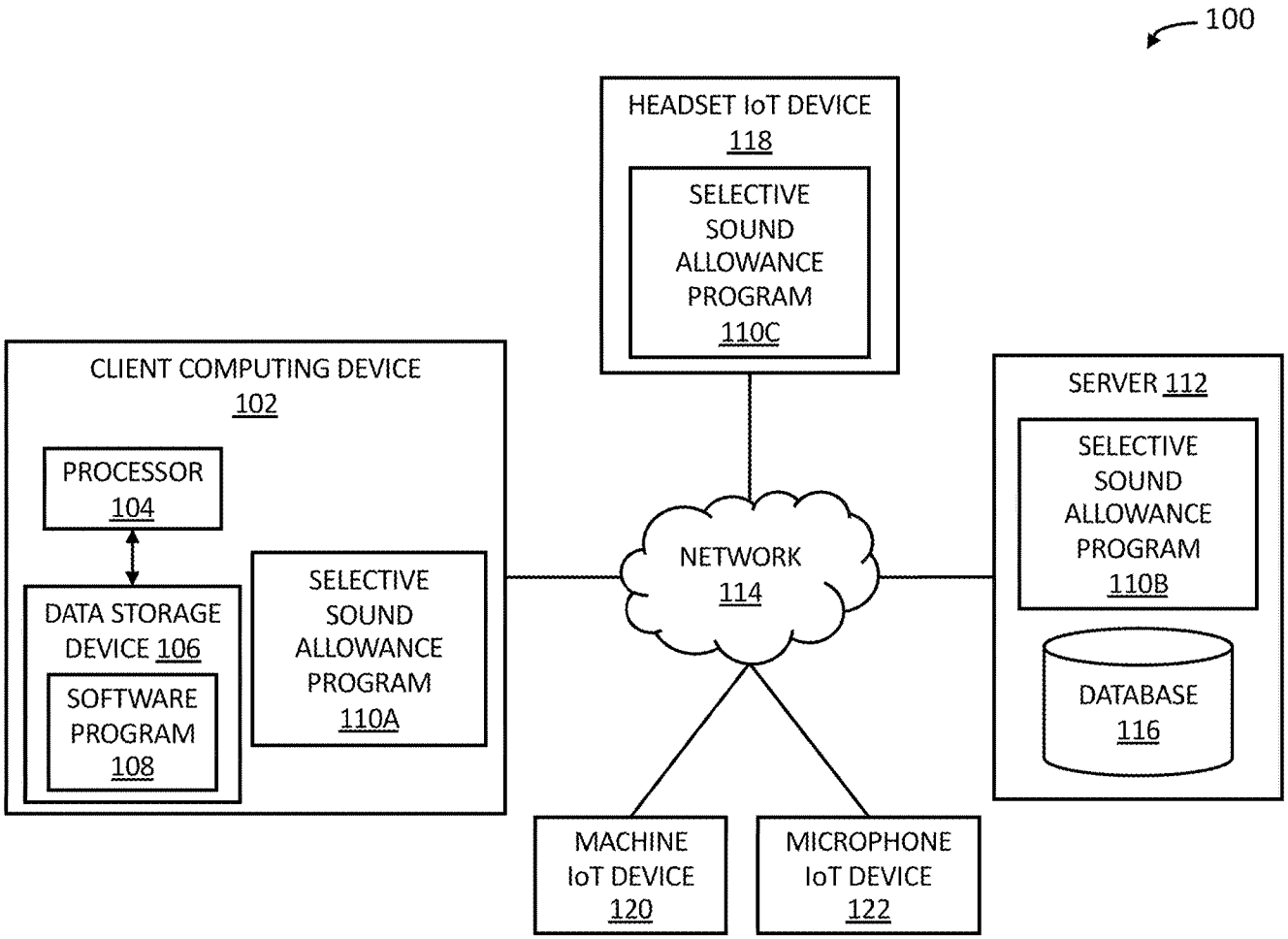
FIG. 1 illustrates an exemplary networked computer environment according to at least one embodiment.

Detailed embodiments of the claimed structures and methods are disclosed herein; however, it can be understood that the disclosed embodiments are merely illustrative of the claimed structures and methods that may be embodied in various forms. This invention may, however, be embodied in many different forms and should not be construed as limited to the exemplary embodiments set forth herein. In the description, details of well-known features and techniques may be omitted to avoid unnecessarily obscuring the presented embodiments.

It is to be understood that the singular forms "a," "an," and "the" include plural referents unless the context clearly dictates otherwise. Thus, for example, reference to "a component surface" includes reference to one or more of such surfaces unless the context clearly dictates otherwise.

The present invention relates generally to the field of computing, and more particularly to active noise control. The following described exemplary embodiments provide a system, method, and program product to, among other things, identify a workplace machine sound as an indication of a potential or occurring accident and, accordingly, selectively allow the sound to be heard within a noise cancellation headset. Therefore, the present embodiment has the capacity to improve the technical field of active noise control applications by allowing a sound to be heard within a noise cancellation headset when the sound has been identified as an indication of a potential or occurring problem within an industrial machine, thus improving employee safety when utilizing a noise cancellation headset in an industrial work environment.

As previously described, ANC is a method for reducing unwanted sound by the addition of a second sound specifically designed to cancel the unwanted sound. Sound is a pressure wave which consists of alternating periods of compression and rarefaction. A noise-cancellation speaker emits a sound wave with the same amplitude but with inverted phase relative to an original sound (e.g., an unwanted sound). In a process called interference, the waves combine to form a new wave and effectively cancel each other out. This effect is called destructive interference. Modern ANC is generally achieved using analog circuits or digital signal processing. Adaptive algorithms are designed to analyze the waveform of the background noise, then generate a signal that will either phase shift or invert the polarity of the original signal. This inverted signal is amplified, and a transducer creates a sound wave directly proportional to the amplitude of the original waveform, creating destructive interference and effectively reducing the volume of the perceivable noise. Noise-cancelling headphones are headphones that reduce unwanted or unsafe sound levels using ANC. For example, in the context of an industrial work environment, employee headsets may employ ANC to mitigate the risk of NIHL.

In industrial work environments (e.g., a machine shop floor) employees are exposed to high levels of noise which may be damaging to employee hearing and possibly result in NIHL. In fact, World Health Organization figures indicate that noise exposure contributes to a notable percentage of workplace related health issues. In an effort to mitigate the risk of hearing damage and NIHL, it is common for employees in industrial work environments to utilize noise cancellation headsets. Such headsets may implement known methods of destructive interference to cancel out the surrounding industrial noise (e.g., noise from industrial machines) as employees perform their work comfortably. However, in any industrial work environment, a sound originating from a machine or its surroundings may be an indication of a current or future problem/accident within the machine or its surroundings. A resulting problem or accident within a machine or its surroundings may present financial harm (e.g., repair costs) to a company as well as physical harm to employees. If noise cancellation headsets are utilized by employees to cancel all noise in an industrial work environment, then the employees present within the environment may not be able to take immediate corrective action (e.g., shutdown, repair) or evacuate the work environment in response to the sound. It may therefore be imperative to have a system in place to selectively allow a sound, from an industrial work environment, to be heard within a noise cancellation headset of a present employee if that sound is indicative of a current or future problem/accident within the industrial work environment. Thus, embodiments of the present invention may be advantageous to, among other things, identifying problematic sounds of a machine or its surroundings, allowing such problematic sounds to be heard by employees wearing noise cancelling headsets, and enhancing employee safety within an industrial work environment. The present invention does not require that all advantages need to be incorporated into every embodiment of the invention.

According to at least one embodiment, a digital twin representation for a given industrial work environment (IWE) may be created which may include a digital twin representation for each machine present within the environment. Additionally, a corpus of machine and surrounding sounds/vibrations harvested from the IWE may be created. Harvested sounds/vibrations within the corpus may be classified, using machine learning, as to whether they are indicative of a problem or not. According to at least one embodiment, employees present within an IWE may be identified and sounds within the IWE may be monitored. If a monitored sound is determined to be indicative of a problem (e.g., an accident) based on comparison to a corpus of classified IWE sounds, a severity of the problem may be identified using a digital twin representation of the sound source (e.g., a machine) and the corpus of classified IWE sounds. Employees present within a boundary range of the problem may be identified and the monitored sound indicative of the problem may be allowed to be heard within noise cancelling headsets utilized by the identified employees.

According to at least one embodiment, an artificial intelligence (AI) (e.g., machine learning) and Internet-of-Things (IoT) enabled system may analyze machine conditions to identify if a sound from any machine or its surroundings is related to predicted damage in the machine or any accident in the surroundings, and accordingly build a corpus of machine and surrounding sounds based on an IoT feed from an IWE. The proposed selective sound allowance system will selectively allow learned sounds so that employees present within an area associated with the damage or accident may hear the sound despite the use of noise cancellation headsets.

According to at least one embodiment, if a sound of an IWE is determined to be an indication of a current or future accident, the proposed system may identify the degree of severity of the accident (e.g., location of accident derived from location of machine producing the sound, type of machine producing the sound, impact of accident on machine and its surroundings) based on analysis of the sound, and dynamically adjust the level of loudness of the sound within noise cancellation headsets of identified employees so that they may be alerted to and proactively respond the accident.

According to at least one embodiment, based on historical learning and use of digital twin simulation, the proposed system may identify an impacted area of the accident, as well as impacted employees, and accordingly identify a boundary range within the IWE where the sound may be allowed to be heard within noise cancellation headsets of the impacted employees.

According to at least one embodiment, if the degree of severity of an accident is comparatively low, then the proposed system may identify only those employees concerned with remediation of the accident (e.g., those who will be rectifying the problem) within the IWE. For other employees in the IWE, the proposed system may continue to cancel the sound, in addition to other noise, within noise cancellation headsets of the other employees.

According to at least one embodiment, if the proposed system identifies that an accident is being rectified, and the chances of future accidents are eliminated or being reduced, then the proposed system may cancel the sound associated with the accident.

According to at least one embodiment, the proposed system may apply a continuous supervised machine learning model to harvested sounds/vibrations from an IWE so that sounds/vibrations and their associated attributes (e.g., source, source location, loudness, sound/vibration type, combination sound/vibration pattern, operational status of source after sound/vibration) may be learned, and an impact of a sound/vibration, in terms of resulting physical damage to an infrastructure/source and/or physical harm to human beings, may be predicted.

According to at least one embodiment, the proposed system may cancel, via the use of noise cancellation headsets, sounds which are not indicative of a current or future problem/accident and may allow select sounds to be heard within the noise cancellation headsets based on the corpus of classified IWE sounds.

According to at least one embodiment, the proposed system may predict, using the corpus of learned IWE sounds and digital twin representations, damage to a machine and/or infrastructure of the IWE and, based on the predicted damage, provide different configured action instructions (e.g., instructions to reduce a rotational speed of a machine) as well messages to identified target employees or devices so that they may be alerted/informed of the damage and proactively respond.

The present invention may be a system, a method, and/or a computer program product at any possible technical detail level of integration. The computer program product may include a computer readable storage medium (or media)

having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed concurrently or substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The following described exemplary embodiments provide a system, method, and program product to determine that a sound from a machine, or its IWE surroundings, is indicative of a current or predicted problem in the machine or within the surroundings and, accordingly, isolate and allow the sound to be heard within noise cancellation headsets with adjusted loudness of the sound.

Referring to FIG. 1, an exemplary networked computer environment 100 is depicted, according to at least one embodiment. The networked computer environment 100 may include a client computing device 102, a server 112, a headset IoT device 118, a machine IoT device 120, and a microphone IoT device 122 interconnected via a communication network 114. According to at least one implementation, the networked computer environment 100 may include a plurality of client computing devices 102, headset IoT devices 118, machine IoT devices 120, microphone IoT devices 122, and servers 112, of which only one of each is shown for illustrative brevity. Additionally, in one or more embodiments, the client computing device 102, the server 114, and the headset IoT device 118 may each host a selective sound allowance program 110A, 110B, 110C. In one or more other embodiments, the selective sound allowance program 110A, 110B, 110C may be partially hosted on client computing device 102, server 114, and on headset IoT device 118 so that functionality may be separated among the devices.

The communication network 114 may include various types of communication networks, such as a wide area network (WAN), local area network (LAN), a telecommunication network, a wireless network, a public switched network and/or a satellite network. The communication network 114 may include connections, such as wire, wireless communication links, or fiber optic cables. It may be appreciated that FIG. 1 provides only an illustration of one implementation and does not imply any limitations with regard to the environments in which different embodiments may be implemented. Many modifications to the depicted environments may be made based on design and implementation requirements.

Client computing device 102 may include a processor 104 and a data storage device 106 that is enabled to host and run a software program 108 and a selective sound allowance program 110A and communicate with the server 112, headset IoT device 118, machine IoT device 120, and microphone IoT device 122 via the communication network 114, in accordance with one embodiment of the invention. Client computing device 102 may be, for example, a mobile device, a telephone, a personal digital assistant, a netbook, a laptop computer, a tablet computer, a desktop computer, or any type of computing device capable of running a program and accessing a network. As will be discussed with reference to FIG. 4, the client computing device 102 may include internal components 402*a* and external components 404*a*, respectively.

The server computer 112 may be a laptop computer, netbook computer, personal computer (PC), a desktop computer, or any programmable electronic device or any network of programmable electronic devices capable of hosting and running a selective sound allowance program 110B and a database 116 and communicating with the client computing device 102, headset IoT device 118, machine IoT device 120, and microphone IoT device 122 via the communication network 114, in accordance with embodiments of the invention. As will be discussed with reference to FIG. 4, the server computer 112 may include internal components 402*b* and external components 404*b*, respectively. The server 112 may also operate in a cloud computing service model, such as Software as a Service (SaaS), Platform as a Service (PaaS), or Infrastructure as a Service (IaaS). The server 112 may also be located in a cloud computing deployment model, such as a private cloud, community cloud, public cloud, or hybrid cloud.

Headset IoT device 118 may be a circumaural or over ear headphones, supra-aural headphones, a headset, and/or any other headset IoT device 118 known in the art for implementing noise cancellation using destructive interference techniques that is capable of connecting to the communication network 114, and transmitting and receiving data with the client computing device 102, machine IoT device 120, microphone IoT device 122, and the server 112. According to at least one implementation, the networked computer environment 100 may include a plurality of headset IoT devices 118. As will be discussed with reference to FIG. 4, the headset IoT device 118 may include internal components 402*c* and external components 404*c*, respectively.

Machine IoT device 120 may be an IoT enabled machine (e.g., an industrial machine within an IWE) with a microphone, and various other sensors, embedded in or external to the machine, that is capable of connecting to the communication network 114, and transmitting and receiving data with the client computing device 102, headset IoT device 118, and the server 112. The microphone of machine IoT device 120 may include, for example, one or more piezoelectric microphone sensors installed to capture the vibration from different portions of a machine or structure. The various other sensors of machine IoT device 120 may include, for example, heat sensors, weight sensors, and pressure sensors, and may gather data of machine IoT device 120 on a continuous basis. According to at least one implementation, the networked computer environment 100 may include a plurality of machine IoT devices 120.

Microphone IoT device 122 may be a microphone and/or any other microphone IoT device 122 known in the art for capturing audio output (e.g., sound/vibration) that is capable of connecting to the communication network 114, and transmitting and receiving data with the client computing device 102, the headset IoT device 118, and the server 112. According to at least one implementation, the networked computer environment 100 may include a plurality of microphone IoT devices 122.

According to the present embodiment, the selective sound allowance program 110A, 110B, 110C may be a program capable of receiving information of a work environment and machines contained therein to create digital twin representations for the work environment and the machines, classifying sounds of a work environment and machines contained therein to create a corpus of learned sounds indicative of a problem, monitoring sounds of a work environment and machines contained therein to determine whether a sound indicative of a problem has been received, identifying a severity of the problem as well as employees near the problem or concerned with remediation of the problem, and allowing a sound indicative of a problem within a work environment or a machine contained therein to be heard through noise cancellation headsets of identified employees. The work environment digital twin creation and sound classification method is explained in further detail below with respect to FIG. 2. The selective sound allowance method is explained in further detail below with respect to FIG. 3.

Figure 2:
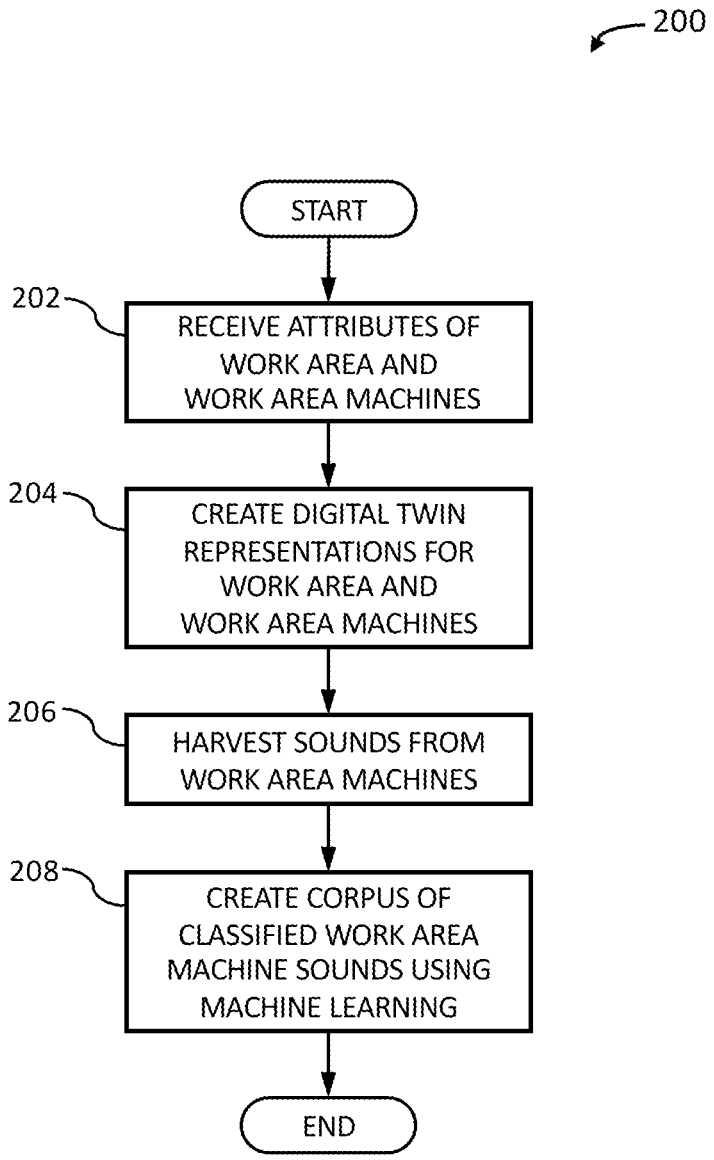
FIG. 2 illustrates an operational flowchart for a work environment digital twin creation and sound classification process according to at least one embodiment.

Referring now to FIG. 2, an operational flowchart for creating digital twin representations of an IWE and creating a corpus of learned IWE sounds in a digital twin creation and sound classification process 200 is depicted according to at least one embodiment. At 202, the selective sound allowance program 110A, 110B, 110C may receive information of an IWE and machines present within the IWE. Utilizing the software program 108, a user may upload the information which may be accessed or received by the selective sound allowance program 110A, 110B, 110C. The information may include physical and non-physical attributes of the IWE such as, but not limited to, physical dimensions of an interior space of the IWE, a floor plan of the IWE, number of employees assigned to work within the IWE, listing of employee identification/badge numbers of employees assigned to work within the IWE, number of machines within the IWE, a layout of machine placement within the IWE, sprinklers and other safety response systems within the IWE, and microphone (e.g., microphone IoT device 122) placement within the IWE. Physical attributes of an IWE may have states, and these states may undergo change across a dimension, such as time. Two or more changes to states of the physical attributes of an IWE may be referred to as experiences or a history of the IWE. Furthermore, two or more changes to states of the non-physical attributes of an IWE may also be part of the experiences or the history of the IWE.

The information may also include physical and non-physical attributes of every machine (e.g., machine IoT device 120) within the IWE. According to at least one embodiment, physical attributes of a machine may include physical dimensions of a machine, machine type, material composition of a machine and its individual components (to varying degrees of granularity), the physical arrangements or configurations of a machine relative to other machines, the physical arrangements or configurations of components of a machine relative to one another or relative to other machines, functions of a machine or its components, one or more IoT sensors embedded within or external to a machine (e.g., the various other sensors of machine IoT device 120). The physical attributes may have states, and these states may undergo change across a dimension, such as time. Two or more changes to states of the physical attributes of a machine may be referred to as experiences or a history of the machine. According to at least one embodiment, non-physical attributes of a machine may include information that describes a machine and its physical attributes, a context of a machine relative to other machines or entities, and information that describes states of a machine's attributes and the changes in those states over time. Two or more changes to states of the non-physical attributes of a machine may also be part of the experiences or the history of the machine. The context of a machine may include information that defines the machine relative to other machines or entities. Non-limiting examples of such context data may include, with respect to a machine: bill of material; maintenance plans; maintenance history; part replacement history; part usage history; specifications; 3-dimensional model and computer-aided design (CAD) drawing data; fault codes; scheduled maintenance plans; operating manuals; usage data, such as IoT sensor readings associated with the machine; assigned employees of a machine; AI and state prediction data; operating history; ownership; and applicable standards. Each such type of context data may also have associated change information.

Then, at 204, the selective sound allowance program 110A, 110B, 110C may create a digital representation of the IWE and digital twin representations for every machine within the IWE based on the information received at 202. According to one definition, a digital twin refers to a digital representation of an IWE or a machine with the IWE, and more broadly, a computerized representation. In IoT systems, a digital twin can represent an evolving virtual data model that mimics the IWE or machine as well as its experiences and state changes. The digital twin may be said, in an embodiment, to store and track information about its twin IWE or machine. According to at least one embodiment, a digital twin stores and tracks information about physical and non-physical attributes of the IWE or machine, a context of the IWE or machine relative to other machines or entities, and information that describes attribute states of the IWE or machine and changes in those states over time. According to at least one embodiment, creating a digital twin generally refers to a computer-implemented process (implemented by executing programming instructions using a processor) by which a digital record comprising the digital twin is created on a non-transitory tangible storage device. The storage device may be decoupled from the IWE or machine and may be a component in a cloud-computing infrastructure available in distributed networks and systems such as the internet or IoT systems. According to at least one embodiment, created digital twins may be created on and stored within the data storage device 106 or the database 116. Creating a digital twin may also be described as instantiating the digital twin.

According to at least one embodiment, a digital twin of an IWE or machine may be created at the same time as the IWE or machine with similar base features as the initial IWE or machine. According to at least one other embodiment, the digital twin may be created at a different time than the IWE or machine (for example, before or after the IWE or machine). For example, the digital twin may be created via a preconfigured data representation of a IWE or machine. At any given point in time, regardless of when the digital twin and the IWE or machine are created, the two may be linked. Linking a digital twin and a corresponding IWE or machine may include, for example, a process by which a data record including or representing the digital twin is modified to refer to unique identifying information of the IWE or machine or to reflect any changes to physical and/or non-physical attributes of the IWE or machine.

In the present embodiment, at 206, the selective sound allowance program 110A, 110B, 110C may harvest sounds/vibrations from a noise-filled environment such as, the IWE and from machines within the IWE. According to at least one embodiment, sounds/vibrations from the IWE and the machines contained therein may be detected and captured via one or more microphones embedded in, or external to, machine IoT devices 120 of the IWE and/or one or more microphone IoT devices 122 which may be deployed throughout the IWE. Captured sounds/vibrations of the IWE and the machines contained therein may be transmitted to the selective sound allowance program 110A, 110B, 110C and stored as a corpus within the data storage device 106 or the database 116. Associated attributes of the captured sounds/vibrations (e.g., source, source location, loudness, sound/vibration type, sound/vibration pattern, combination sound/vibration pattern, operational status of source after sound/vibration, resulting impact on source, remediation instructions in response to sound/vibration) may also be transmitted to the selective sound allowance program 110A, 110B, 110C and stored within the corpus.

Next, at 208, the selective sound allowance program 110A, 110B, 110C may classify the corpus of received sounds/vibrations created at 206. According to at least one embodiment, the selective sound allowance program 110A, 110B, 110C may apply a known continuous supervised machine learning model to the corpus of sounds/vibrations and associated attributes so that a classification as to whether or not a sound/vibration is indicative of a problem/accident may be made by the model. According to various embodiments, a problem/accident may include, but is not limited to, a mechanical malfunction of a machine, an electrical malfunction of a machine, an out of tolerance heat condition of a machine, and a hazardous condition (e.g., fire, smoke, chemical exposure, etc.) of the IWE. A user defined training set of labeled sounds/vibrations (i.e., sounds/vibrations labeled as problematic or normal), with associated attributes such as those listed above, may be uploaded by the user via the software program 108 and may be accessed or received by the selective sound allowance program 110A, 110B, 110C in training a continuous supervised machine learning model. The classification (e.g., problematic, normal) for a sound/vibration of the corpus may be stored within the corpus along with the sound/vibration and its associated attributes. Moreover, depending on the classification of the sound/vibration, a noise cancellation attribute (e.g., cancel sound, allow sound) may be defined for the sound/vibration and stored within the corpus as one of the associated attributes of the sound/vibration. According to at least one embodiment, application of the trained machine learning model to the corpus of sounds/vibrations may be continuous as new sounds/vibrations are added to the corpus by the selective sound allowance program 110A, 110B, 110C. The user defined training set and the classified corpus of sounds/vibrations may serve as historical data (i.e., a knowledge corpus) for reference and comparison by the selective sound allowance program 110A, 110B, 110C in evaluating future sounds/vibrations.

Figure 3:
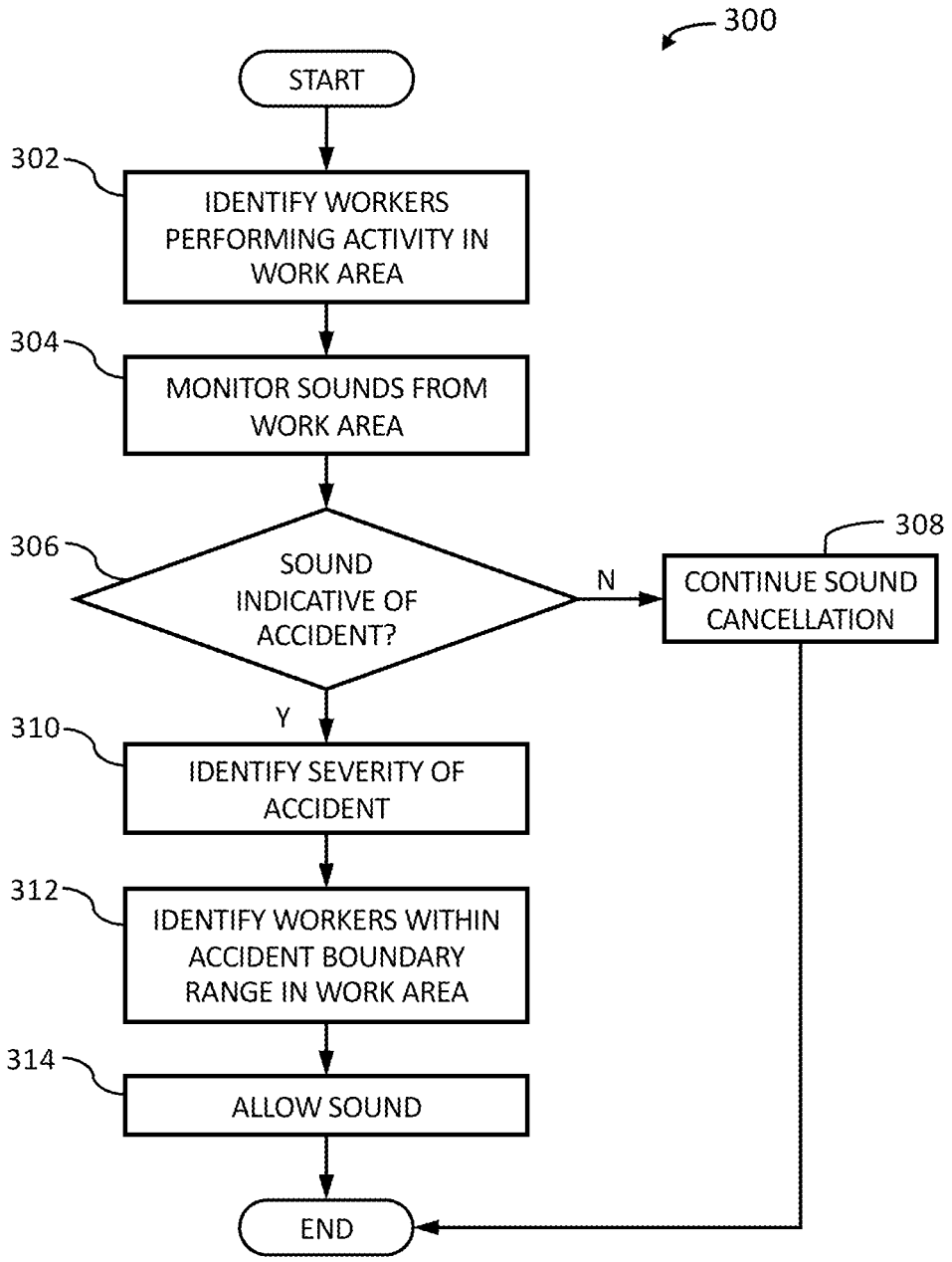
FIG. 3 illustrates an operational flowchart for selectively allowing a sound to be heard within noise cancellation headsets in a selective sound allowance process according to at least one embodiment.

Referring now to FIG. 3, an operational flowchart for selectively allowing a sound to be heard within noise cancellation headsets in a selective sound allowance process 300 is depicted according to at least one embodiment. At 302, the selective sound allowance program 110A, 110B, 110C may identify users (e.g., employees) who are performing activity within a noise-filled environment such as the IWE and utilizing noise cancellation headsets (e.g., headset IoT device 118). According to an example embodiment, employee use of noise cancellation headsets may be required when performing activity within the IWE and the selective sound allowance program 110A, 110B, 110C may be actively cancelling noise of the IWE within the noise cancellation headsets worn by employees. In identifying a user in the IWE, the selective sound allowance program 110A, 110B, 110C may also identify a role (e.g., a work assignment, a machine assignment) of the employee within the IWE. According to at least one embodiment, an employee present within the IWE may be identified and located via a trackable employee specific badge; the location of which may be tracked using known technologies for indoor positioning (e.g., radio frequency identification, WiFi, Bluetooth) and shared with the selective sound allowance program 110A, 110B, 110C. According to another embodiment, an employee present within the IWE may be identified and located via an employee specific noise cancellation headset issued to the employee for use when present in the IWE. A location of the noise cancellation headset may be tracked using known technologies for indoor positioning and shared with the selective sound allowance program 110A, 110B, 110C. According to yet another embodiment, an employee present within the IWE may be identified and located via a pre-determined employee work schedule/assignment for the IWE which may be uploaded to the selective sound allowance program 110A, 110B, 110C.

At 304, the selective sound allowance program 110A, 110B, 110C may monitor sounds of the IWE, including sounds from machines (e.g., machine IoT device 120) within the IWE. According to an embodiment, the selective sound allowance program 110A, 110B, 110C may receive sounds/vibrations, along with associated attributes, from one or more microphones embedded in, or external to, machine IoT devices 120 of the IWE and/or one or more microphone IoT devices 122 which may be deployed throughout the IWE. Additionally, the selective sound allowance program 110A, 110B, 110C may identify a current level of loudness of a received sound and a source of the received sound. The source of a received sound may be identified based on the microphone which captured the sound. For example, a particular machine of the IWE may be identified as the source of a received sound if the received sound was captured by a microphone embedded in, or external to, the particular machine.

Next, at 306, the selective sound allowance program 110A, 110B, 110C may determine if a sound received while monitoring sounds of the IWE is indicative of a problem/accident within a machine or its surroundings in the IWE. According to at least one embodiment, the selective sound allowance program 110A, 110B, 110C may reference/compare the received sound/vibration against historical data (i.e., the user defined training set and the classified corpus of received sounds/vibrations described in process 200) in determining whether the received sound/vibration is indicative of a problem/accident. According to another embodiment, the selective sound allowance program 110A, 110B, 110C may apply the machine learning model of process 200 to determine whether the received sound/vibration is indicative of a problem/accident. For example, a sound/vibration classified by the machine learning model as problematic may be determined as indicative of a problem/accident. In various embodiments, the selective sound allowance program 110A, 110B, 110C may add the received sound/vibration, along with its associated attributes, to the corpus of received sounds/vibrations described above in process 200. In response to determining the received sound/vibration is indicative of a problem/accident (step 306, "Y" branch), the selective sound allowance process 300 may isolate the received sound/vibration from other sounds/vibrations of the IWE and proceed to step 310. In response to determining the received sound/vibration is not indicative of a problem/accident (step 306, "N" branch), the selective sound allowance process 300 may proceed to step 308.

At 308, the selective sound allowance program 110A, 110B, 110C may continue to cancel the received sound/vibration within the noise cancellation headsets utilized by employees when performing activity within the IWE. The selective sound allowance program 110A, 110B, 110C may utilize known destructive interference techniques to cancel the received sound/vibration within the noise cancellation headsets.

At 310, the selective sound allowance program 110A, 110B, 110C may identify or predict a severity of the problem/accident indicated by the received sound. The severity of the problem/accident may include, among other things, a location of the problem/accident and a machine identification as derived from the received sound and its corresponding machine source. The severity of the problem/accident may also include a resulting impact, in terms of physical damage to the machine source or the IWE and/or physical harm to human beings, associated with the received sound. According to at least one embodiment, the selective sound allowance program 110A, 110B, 110C may utilize historical data in combination with data from digital twin representations of the machine source and/or the IWE in identifying or predicting the severity of the problem/accident indicated by the received sound. Furthermore, utilizing historical data with data from digital twin simulations of the machine source and the IWE, the selective sound allowance program 110A, 110B, 110C may identify an impacted area, within the IWE, of the problem/accident, and, accordingly, may identify a boundary range for the problem/accident within the IWE. Depending on the severity of the problem/accident, the boundary range for the problem/accident may be limited to the identified impacted area or may expand beyond it. For example, if the severity of the problem/accident is comparatively low (e.g., below a threshold value), then the selective sound allowance program 110A, 110B, 110C may limit the boundary range to the identified impacted area. Whereas, if the severity of the problem/accident is comparatively high (e.g., equal to or above a threshold value), then the selective sound allowance program 110A, 110B, 110C may expand the boundary range beyond the identified impacted area to potentially include the entire IWE. Threshold values may be pre-configured user defined situations (e.g., impacts on sound sources) such as, but not limited to, fire within or near a sound source or structural vibration of a sound source. Threshold values may also be derived from historical data and may include an operational status of the sound source after sound/vibration or a resulting impact on the sound source.

Next, at 312, the selective sound allowance program 110A, 110B, 110C may identify all employees located within the identified boundary range for the problem/accident. Employees within the boundary range may be tracked and consequently identified via their issued employee badges or noise cancellation headsets using known technologies for indoor positioning. Employees within the boundary range may also be identified via the use a pre-established mapping of the IWE with machine locations and employee assignments to machine locations. According to at least one other embodiment, the selective sound allowance program 110A, 110B, 110C may identify only those employees within the boundary range tasked with rectifying the problem/accident.

Then, at 314, the selective sound allowance program 110A, 110B, 110C may allow the received sound to be heard within the noise cancellation headsets of identified employees within the boundary range for the problem/accident. According to at least one embodiment, the selective sound allowance program 110A, 110B, 110C may dynamically alter (e.g., increase, decrease) a loudness level of the received sound so that the identified employees within the boundary range can hear the received sound through their noise cancellation headsets, be alerted to the problem/accident, and proactively respond. The selective sound allowance program 110A, 110B, 110C may continue to cancel the received sound, in addition to other noise, within the noise cancellation headsets of other employees within the IWE. According to at least one embodiment, in addition to dynamically altering the loudness level of the received sound, the selective sound allowance program 110A, 110B, 110C may temporarily suspend the use of destructive interference techniques within the noise cancellation headsets of identified employees within the boundary range for the problem/accident. According to at least one embodiment, the selective sound allowance program 110A, 110B, 110C may identify that the problem/accident is being rectified (e.g., via data received from the various sensors of machine IoT device 120) and/or that chances of the problem/accident are eliminated or being reduced, and, accordingly, cancel the received sound within the noise cancellation headsets of identified employees within the boundary range for the problem/accident. According to at least one embodiment, in addition to allowing the received sound to be heard within the noise cancellation headsets, the selective sound allowance program 110A, 110B, 110C may provide a configured action item (i.e., remediation instructions), as well as a message, to identified employees within the boundary range for the problem/accident in response to the received sound. The message may include a warning, an alert, or recommended safety actions in response to the problem/accident. Configured action items and messages may be in the form of audio messages transmitted through the noise cancellation headsets (e.g., headset IoT device 118) of identified employees within the boundary range for the problem/accident. Configured action items and messages may also be in the form of text messages transmitted to machines (e.g., machine IoT device 120) of the IWE.

It may be appreciated that FIGS. 2 and 3 provide only an illustration of one implementation and do not imply any limitations with regard to how different embodiments may be implemented. Many modifications to the depicted environments may be made based on design and implementation requirements.

Figure 4:
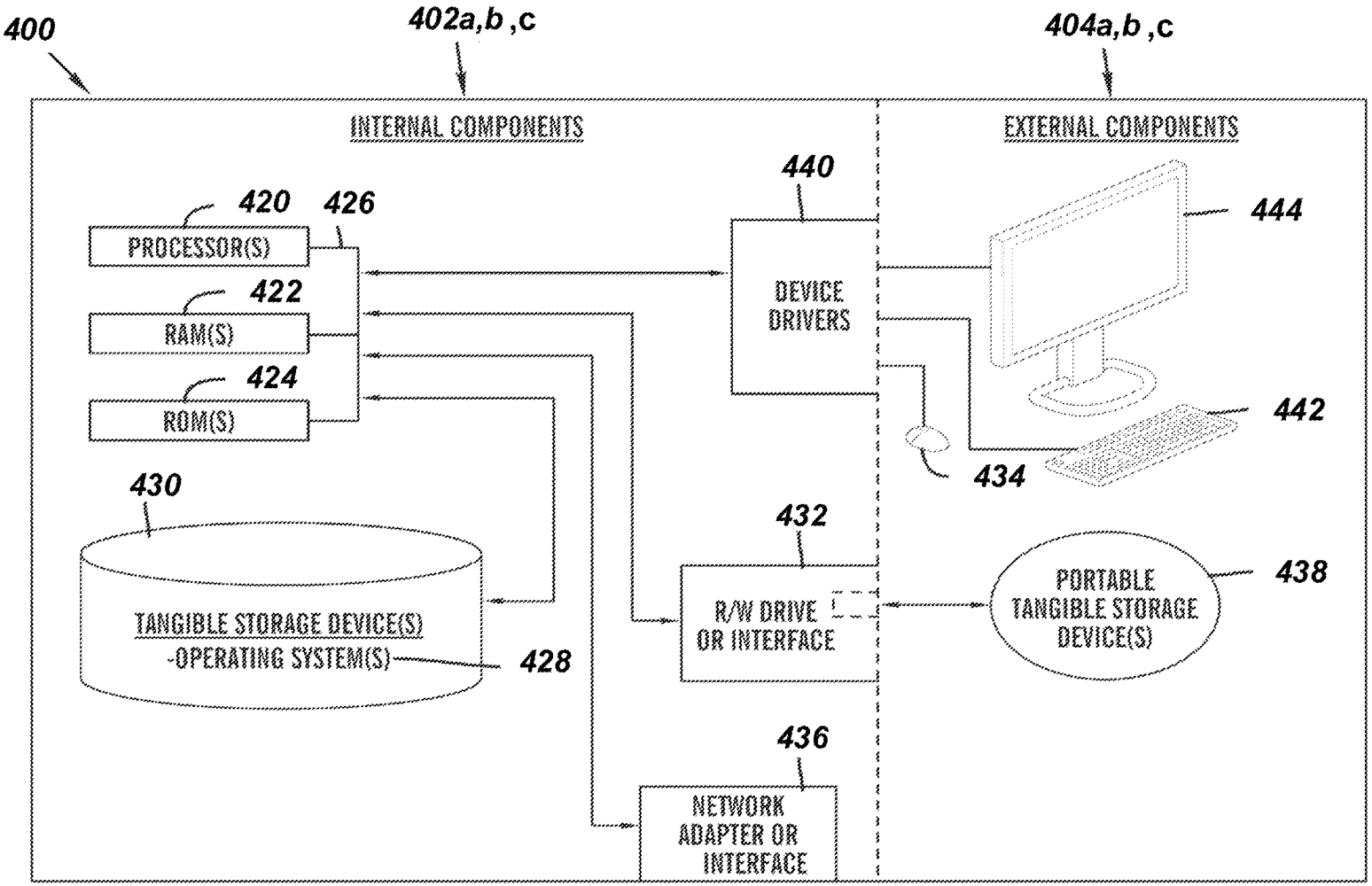
FIG. 4 is a functional block diagram of internal and external components of computers and servers depicted in FIG. 1 according to at least one embodiment.

FIG. 4 is a block diagram 400 of internal and external components of the client computing device 102, the server 112, and the headset IoT device 118 depicted in FIG. 1 in accordance with an embodiment of the present invention. It should be appreciated that FIG. 4 provides only an illustration of one implementation and does not imply any limitations with regard to the environments in which different embodiments may be implemented. Many modifications to the depicted environments may be made based on design and implementation requirements.

The data processing system 402, 404 is representative of any electronic device capable of executing machine-readable program instructions. The data processing system 402, 404 may be representative of a smart phone, a computer system, PDA, or other electronic devices. Examples of computing systems, environments, and/or configurations that may represented by the data processing system 402, 404 include, but are not limited to, personal computer systems, server computer systems, thin clients, thick clients, handheld or laptop devices, multiprocessor systems, microprocessor-based systems, network PCs, minicomputer systems, IoT devices, and distributed cloud computing environments that include any of the above systems or devices.

The client computing device 102, the server 112, and the headset IoT device 118 may include respective sets of internal components 402 *a,b,c* and external components 404 *a,b,c* illustrated in FIG. 4. Each of the sets of internal components 402 include one or more processors 420, one or more computer-readable RAMs 422, and one or more computer-readable ROMs 424 on one or more buses 426, and one or more operating systems 428 and one or more computer-readable tangible storage devices 430. The one or more operating systems 428, the software program 108 and the selective sound allowance program 110A in the client computing device 102, the selective sound allowance program 110B in the server 112, and the selective sound allowance program 110C in the headset IoT device 118 are stored on one or more of the respective computer-readable tangible storage devices 430 for execution by one or more of the respective processors 420 via one or more of the respective RAMs 422 (which typically include cache memory). In the embodiment illustrated in FIG. 4, each of the computer-readable tangible storage devices 430 is a magnetic disk storage device of an internal hard drive. Alternatively, each of the computer-readable tangible storage devices 430 is a semiconductor storage device such as ROM 424, EPROM, flash memory or any other computer-readable tangible storage device that can store a computer program and digital information.

Each set of internal components 402 *a,b,c* also includes a R/W drive or interface 432 to read from and write to one or more portable computer-readable tangible storage devices 438 such as a CD-ROM, DVD, memory stick, magnetic tape, magnetic disk, optical disk or semiconductor storage device. A software program, such as the selective sound allowance program 110A, 110B, 110C can be stored on one or more of the respective portable computer-readable tangible storage devices 438, read via the respective R/W drive or interface 432, and loaded into the respective hard drive 430.

Each set of internal components 402 *a,b,c* also includes network adapters or interfaces 436 such as a TCP/IP adapter cards, wireless Wi-Fi interface cards, or 3G or 4G wireless interface cards or other wired or wireless communication links. The software program 108 and the selective sound allowance program 110A in the client computing device 102, the selective sound allowance program 110B in the server 112, and the selective sound allowance program 110C in the headset IoT device 118 can be downloaded to the client computing device 102, the server 112, and the headset IoT device 118 from an external computer via a network (for example, the Internet, a local area network or other, wide area network) and respective network adapters or interfaces 436. From the network adapters or interfaces 436, the software program 108 and the selective sound allowance program 110A in the client computing device 102, the selective sound allowance program 110B in the server 112, and the selective sound allowance program 110C in the headset IoT device 118 are loaded into the respective hard drive 430. The network may comprise copper wires, optical fibers, wireless transmission, routers, firewalls, switches, gateway computers and/or edge servers.

Each of the sets of external components 404 *a,b,c* can include a computer display monitor 444, a keyboard 442, and a computer mouse 434. External components 404 *a,b,c* can also include touch screens, virtual keyboards, touch pads, pointing devices, and other human interface devices. Each of the sets of internal components 402 *a,b,c* also includes device drivers 440 to interface to computer display monitor 444, keyboard 442, and computer mouse 434. The device drivers 440, R/W drive or interface 432, and network adapter or interface 436 comprise hardware and software (stored in storage device 430 and/or ROM 424).

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 5:
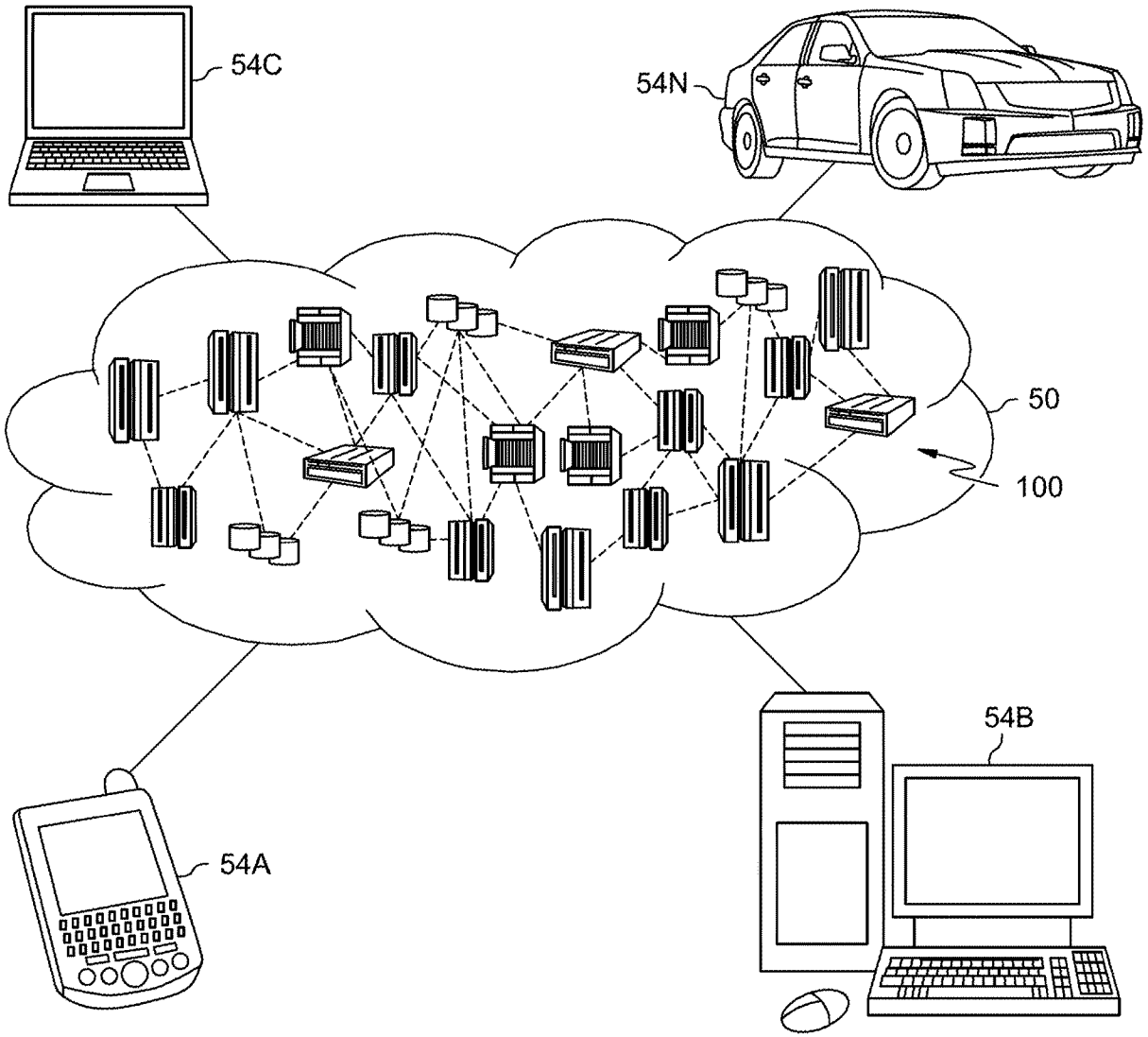
FIG. 5 depicts a cloud computing environment according to an embodiment of the present invention.

Referring now to FIG. 5, illustrative cloud computing environment 50 is depicted. As shown, cloud computing environment 50 comprises one or more cloud computing nodes 100 with which local computing devices used by cloud consumers, such as, for example, personal digital assistant (PDA) or cellular telephone 54A, desktop computer 54B, laptop computer 54C, and/or automobile computer system 54N may communicate. Nodes 100 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 5 are intended to be illustrative only and that computing nodes 100 and cloud computing environment 50 can communicate with any type of computerized device over any type of network and/or network addressable connection (e.g., using a web browser).

Figure 6:
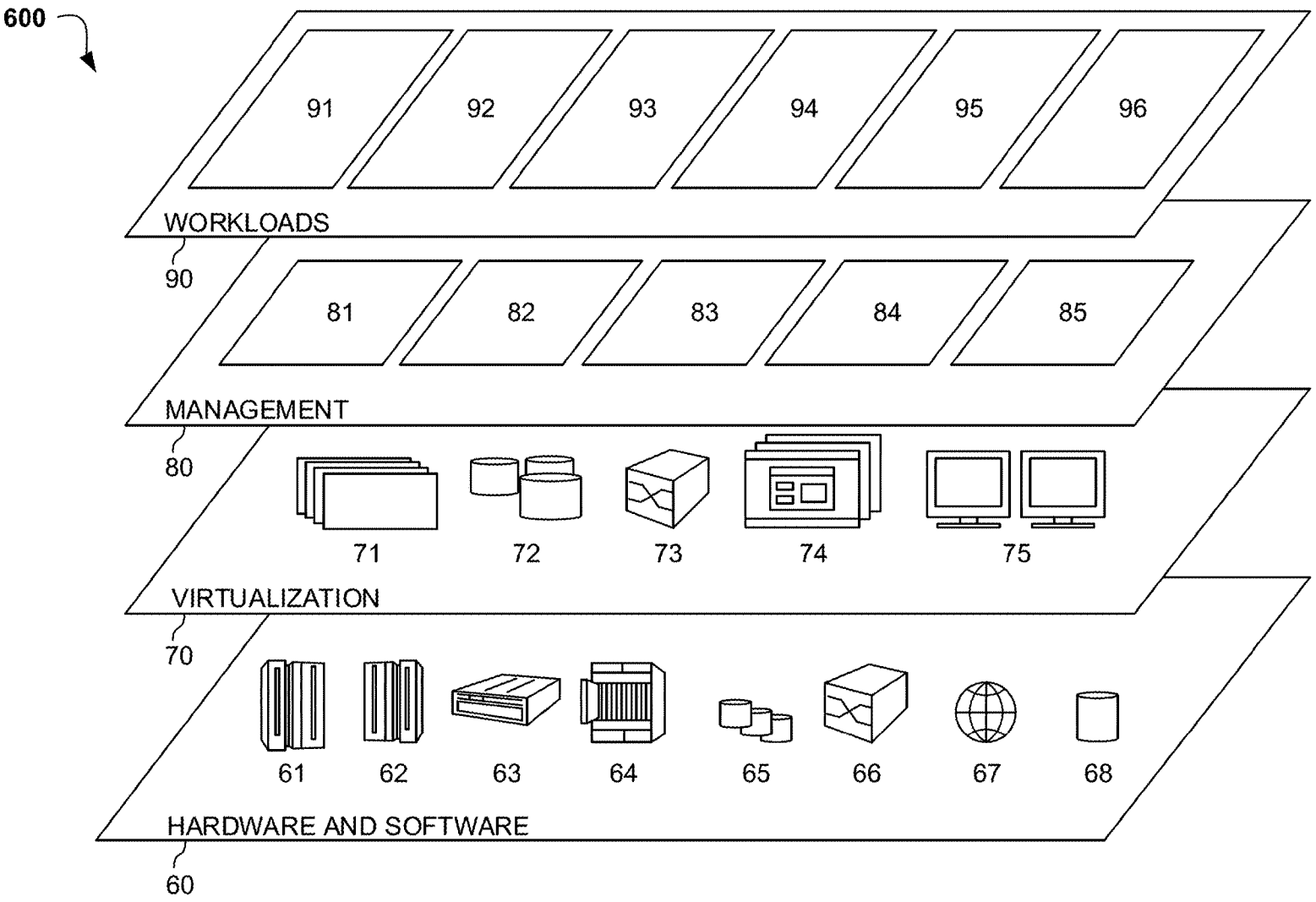
FIG. 6 depicts abstraction model layers according to an embodiment of the present invention.

Referring now to FIG. 6, a set of functional abstraction layers 600 provided by cloud computing environment 50 is shown. It should be understood in advance that the components, layers, and functions shown in FIG. 6 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and selective sound allowance 96. Selective sound allowance 96 may relate to selectively allowing a sound to be heard within a noise cancellation headset.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-based method of allowing selective sounds within a noise cancellation headset, the method comprising:

receiving a sound from a noise-filled environment, wherein a source of the sound is a machine within the noise-filled environment;

determining that the sound is indicative of a problem within the noise-filled environment;

identifying a severity of the problem, wherein identifying the severity of the problem further comprises:

using historical data in combination with data from digital twin representations of the noise-filled environment and the machine to identify the severity of the problem; and identifying an impacted area, within the noise-filled environment, of the problem using the historical data in combination with the data from digital twin representations of the noise-filled environment and the machine;

identifying a user within a boundary range of the problem, wherein the boundary range is based, in part, on the severity of the problem, and wherein the user is wearing a noise cancellation headset which is actively cancelling sounds of the noise-filled environment; and allowing the sound to be heard within the noise cancellation headset of the identified user.

2. The method of claim 1, wherein the sound is captured by one or more microphones embedded in, or external to, the machine, and wherein the sound may comprise a vibration.

3. The method of claim 1, further comprising:

receiving information of the noise-filled environment and of one or more machines present within the noise-filled environment, wherein the information comprises physical and non-physical attributes of the noise-filled environment and the one or more machines;

creating a digital twin representation of the noise-filled environment and digital twin representations for the one or more machines;

harvesting sounds from the noise-filled environment and the one or more machines, wherein the harvested sounds comprise associated attributes;

creating a corpus of sounds comprising the harvested sounds; and classifying the harvested sounds of the corpus of sounds as problematic or normal by applying a supervised machine learning model to the harvested sounds and associated attributes.

4. The method of claim 1, wherein determining that the sound is indicative of a problem within the noise-filled environment further comprises:

comparing the sound to a corpus of classified sounds of the noise-filled environment, wherein a classification of the classified sounds of the noise-filled environment comprises a problematic classification or a normal classification.

5. The method of claim 1, wherein the boundary range of the problem is limited to the impacted area, within the noise-filled environment, of the problem if the severity of the problem is below a threshold.

6. The method of claim 1, wherein identifying the user within the boundary range comprises tracking the user via a trackable user specific badge or a trackable user specific noise cancellation headset.

7. A computer system, the computer system comprising:

one or more processors, one or more computer-readable memories, one or more computer-readable tangible storage medium, and program instructions stored on at least one of the one or more tangible storage medium for execution by at least one of the one or more processors via at least one of the one or more memories, wherein the computer system is capable of performing a method comprising:

receiving a sound from a noise-filled environment, wherein a source of the sound is a machine within the noise-filled environment;

determining that the sound is indicative of a problem within the noise-filled environment;

identifying a severity of the problem, wherein identifying the severity of the problem further comprises:

using historical data in combination with data from digital twin representations of the noise-filled environment and the machine to identify the severity of the problem; and identifying an impacted area, within the noise-filled environment, of the problem using the historical data in combination with the data from digital twin representations of the noise-filled environment and the machine;

identifying a user within a boundary range of the problem, wherein the boundary range is based, in part, on the severity of the problem, and wherein the user is wearing a noise cancellation headset which is actively cancelling sounds of the noise-filled environment; and allowing the sound to be heard within the noise cancellation headset of the identified user.

8. The computer system of claim 7, wherein the sound is captured by one or more microphones embedded in, or external to, the machine, and wherein the sound may comprise a vibration.

9. The computer system of claim 7, further comprising:

receiving information of the noise-filled environment and of one or more machines present within the noise-filled environment, wherein the information comprises physical and non-physical attributes of the noise-filled environment and the one or more machines;

creating a digital twin representation of the noise-filled environment and digital twin representations for the one or more machines;

harvesting sounds from the noise-filled environment and the one or more machines, wherein the harvested sounds comprise associated attributes;

creating a corpus of sounds comprising the harvested sounds; and classifying the harvested sounds of the corpus of sounds as problematic or normal by applying a supervised machine learning model to the harvested sounds and associated attributes.

10. The computer system of claim 7, wherein determining that the sound is indicative of a problem within the noise-filled environment further comprises:

comparing the sound to a corpus of classified sounds of the noise-filled environment, wherein a classification of the classified sounds of the noise-filled environment comprises a problematic classification or a normal classification.

11. The computer system of claim 7, wherein the boundary range of the problem is limited to the impacted area, within the noise-filled environment, of the problem if the severity of the problem is below a threshold.

12. The computer system of claim 7, wherein identifying the user within the boundary range comprises tracking the user via a trackable user specific badge or a trackable user specific noise cancellation headset.

13. A computer program product, the computer program product comprising:

one or more computer-readable tangible storage medium and program instructions stored on at least one of the one or more tangible storage medium, the program instructions executable by a processor capable of performing a method, the method comprising:

receiving a sound from a noise-filled environment, wherein a source of the sound is a machine within the noise-filled environment;

determining that the sound is indicative of a problem within the noise-filled environment;

identifying a severity of the problem, wherein identifying the severity of the problem further comprises:

using historical data in combination with data from digital twin representations of the noise-filled environment and the machine to identify the severity of the problem; and identifying an impacted area, within the noise-filled environment, of the problem using the historical data in combination with the data from digital twin representations of the noise-filled environment and the machine;

identifying a user within a boundary range of the problem, wherein the boundary range is based, in part, on the severity of the problem, and wherein the user is wearing a noise cancellation headset which is actively cancelling sounds of the noise-filled environment; and allowing the sound to be heard within the noise cancellation headset of the identified user.

14. The computer program product of claim 13, wherein the sound is captured by one or more microphones embedded in, or external to, the machine, and wherein the sound may comprise a vibration.

15. The computer program product of claim 13, further comprising:

receiving information of the noise-filled environment and of one or more machines present within the noise-filled environment, wherein the information comprises physical and non-physical attributes of the noise-filled environment and the one or more machines;

creating a digital twin representation of the noise-filled environment and digital twin representations for the one or more machines;

harvesting sounds from the noise-filled environment and the one or more machines, wherein the harvested sounds comprise associated attributes;

creating a corpus of sounds comprising the harvested sounds; and classifying the harvested sounds of the corpus of sounds as problematic or normal by applying a supervised machine learning model to the harvested sounds and associated attributes.

16. The computer program product of claim 13, wherein determining that the sound is indicative of a problem within the noise-filled environment further comprises:

comparing the sound to a corpus of classified sounds of the noise-filled environment, wherein a classification of the classified sounds of the noise-filled environment comprises a problematic classification or a normal classification.

17. The computer program product of claim 13, wherein the boundary range of the problem is limited to the impacted area, within the noise-filled environment, of the problem if the severity of the problem is below a threshold.

* * * * *